US011380260B2

(12) United States Patent
Tan et al.

(10) Patent No.: US 11,380,260 B2
(45) Date of Patent: Jul. 5, 2022

(54) DEVICE AND METHOD FOR PANEL CONDITIONING

(71) Applicant: Apple Inc., Cupertino, CA (US)

(72) Inventors: Junhua Tan, Saratoga, CA (US); Kingsuk Brahma, Mountain View, CA (US); Jie Won Ryu, Santa Clara, CA (US); Shengkui Gao, San Jose, CA (US); Shiping Shen, Cupertino, CA (US); Majid Gharghi, San Carlos, CA (US); Hyunwoo Nho, Palo Alto, CA (US); Injae Hwang, Cupertino, CA (US); Kavinaath Murugan, Scarborough (CA); Sun-Il Chang, San Jose, CA (US); Chin-Wei Lin, San Jose, CA (US); Hyunsoo Kim, Mountain View, CA (US); Rui Zhang, Sunnyvale, CA (US); Jesse Aaron Richmond, San Francisco, CA (US); Yun Wang, Cupertino, CA (US); Hung Sheng Lin, San Jose, CA (US)

(73) Assignee: Apple Inc., Cupertino, CA (US)

( * ) Notice: Subject to any disclaimer, the term of this patent is extended or adjusted under 35 U.S.C. 154(b) by 262 days.

(21) Appl. No.: 16/603,189

(22) PCT Filed: Mar. 27, 2018

(86) PCT No.: PCT/US2018/024586
§ 371 (c)(1),
(2) Date: Oct. 4, 2019

(87) PCT Pub. No.: WO2018/187092
PCT Pub. Date: Oct. 11, 2018

(65) Prior Publication Data

US 2021/0082349 A1 Mar. 18, 2021

Related U.S. Application Data

(63) Continuation of application No. 15/699,424, filed on Sep. 8, 2017, now abandoned.
(Continued)

(51) Int. Cl.
*G09G 3/3233* (2016.01)
*G09G 3/3258* (2016.01)
(Continued)

(52) U.S. Cl.
CPC ..... *G09G 3/3258* (2013.01); *G09G 3/3233* (2013.01); *G09G 3/3266* (2013.01);
(Continued)

(58) Field of Classification Search
CPC .. G09G 3/3258; G09G 3/3233; G09G 3/3266; G09G 3/3275; G09G 3/3291;
(Continued)

(56) References Cited

U.S. PATENT DOCUMENTS 8,497,828 B2 * 7/2013 Chaji ..... G09G 3/3283 345/82
8,922,544 B2 12/2014 Chaji et al.
(Continued)

OTHER PUBLICATIONS

International Search Report and Written Opinion for PCT/US2018/024586 dated Jun. 21, 2018, 15 pages.

*Primary Examiner* — Michael J Eurice
(74) *Attorney, Agent, or Firm* — Fletcher Yoder, P.C.

(57) ABSTRACT

An electronic device comprises a controller. The controller is configured to provide a first signal to a display of the electronic device to turn off the display. The controller is also configured to provide a second signal to the display to alter a gate source voltage of a drive transistor coupled to a light emitting diode (LED) of a pixel of the display while the display is turned off.

20 Claims, 9 Drawing Sheets

Related U.S. Application Data

(60) Provisional application No. 62/483,264, filed on Apr. 7, 2017.

(51) Int. Cl.
*G09G 3/3275* (2016.01)
*G09G 3/3266* (2016.01)

(52) U.S. Cl.
CPC ..... *G09G 3/3275* (2013.01); *G09G 2310/061* (2013.01); *G09G 2310/08* (2013.01); *G09G 2320/0257* (2013.01); *G09G 2320/045* (2013.01); *G09G 2330/021* (2013.01); *G09G 2330/027* (2013.01)

(58) Field of Classification Search
CPC ..... G09G 2300/043; G09G 2300/0819; G09G 2300/0842; G09G 2300/0861; G09G 2300/0866; G09G 2300/0876; G09G 2310/0245; G09G 2310/06; G09G 2310/061; G09G 2310/08; G09G 2320/0233; G09G 2320/0257; G09G 2320/0285; G09G 2320/041; G09G 2320/043; G09G 2320/045; G09G 2320/046; G09G 2320/0295; G09G 2330/02; G09G 2330/021; G09G 2330/027
See application file for complete search history.

(56) References Cited

U.S. PATENT DOCUMENTS

2009/0201231 A1* 8/2009 Takahara ..... G09G 3/3233 345/76
2010/0123649 A1* 5/2010 Hamer ..... G09G 3/3225 345/76
2013/0342431 A1* 12/2013 Saeedi ..... G09G 3/3607 345/87
2014/0071027 A1* 3/2014 Jin ..... G09G 3/3233 345/76
2014/0160093 A1* 6/2014 Chaji ..... G09G 3/3258 345/204
2014/0320475 A1* 10/2014 Shin ..... G09G 3/3275 345/212
2015/0138177 A1* 5/2015 Kwon ..... G09G 3/3233 345/211
2015/0154910 A1* 6/2015 Okuno ..... G09G 3/3258 345/212
2015/0187270 A1* 7/2015 Lee ..... G09G 3/3266 345/76
2016/0027382 A1* 1/2016 Chaji ..... G09G 3/3233 345/212
2016/0260378 A1 9/2016 Tsuge
2017/0186371 A1* 6/2017 Takahashi ..... G06F 3/0412
2018/0151656 A1* 5/2018 Choo ..... G09G 3/3291
2020/0043410 A1* 2/2020 Ka ..... G09G 3/3233

* cited by examiner

DEVICE AND METHOD FOR PANEL CONDITIONING

CROSS REFERENCE TO RELATED APPLICATIONS

This application is a national stage filing of PCT Application No. PCT/US2018/024586, filed Mar. 27, 2018, and entitled, "Device and Method for Panel Conditioning," which is a continuation of and claims priority to U.S. Non-Provisional application Ser. No. 15/699,424, filed Sep. 8, 2017, and entitled, "Device and Method for Panel Conditioning," which claims priority to and the benefit of U.S. Provisional Application No. 62/483,264, filed Apr. 7, 2017, and entitled "Device and Method for Panel Conditioning," the disclosures of which are hereby incorporated by reference in their entireties.

BACKGROUND

The present disclosure relates generally to electronic displays and, more particularly, to devices and methods for achieving a reduction in visual artifacts related to hysteresis of a light emitting diode (LED) electronic display.

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Flat panel displays, such as active matrix organic light emitting diode (AMOLED) displays, micro-LED (μLED) displays, and the like, are commonly used in a wide variety of electronic devices, including such consumer electronics as televisions, computers, and handheld devices (e.g., cellular telephones, audio and video players, gaming systems, and so forth). Such display panels typically provide a flat display in a relatively thin package that is suitable for use in a variety of electronic goods. In addition, such devices may use less power than comparable display technologies, making them suitable for use in battery-powered devices or in other contexts where it is desirable to minimize power usage.

LED displays typically include picture elements (e.g. pixels) arranged in a matrix to display an image that may be viewed by a user. Individual pixels of an LED display may generate light as a voltage is applied to each pixel. The voltage applied to a pixel of an LED display may be regulated by, for example, thin film transistors (TFTs). For example, a circuit switching TFT may be used to regulate current flowing into a storage capacitor, and a driver TFT may be used to regulate the voltage being provided to the LED of an individual pixel. However, undesirable visual artifacts may present themselves during the use of the displays. Finally, the growing reliance on electronic devices having LED displays has generated interest in reduction of visual disturbances on the display.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

The present disclosure relate to devices and methods for reduction of artifacts remaining on LED displays, such as AMOLED or μLED displays. Visual artifacts that remain on a display may be referred to as image retention, image persistence, sticking artifacts, ghost images, etc. and may cause an image to appear to remain on a display for a period of time after its image content is no longer being provided to the display. One cause of this particular type of visual artifact may be hysteresis of driver TFTs of the display (e.g., a lag between a present input and a past input affecting the operation of the driver TFTs, thereby allowing current to pass to an LED to cause light emissions therefrom), whereby the driver TFTs with slower hysteresis time constants cause the visual artifact to remain on the display for an increased amount of time.

Accordingly, to reduce and/or eliminate these types of visual artifacts, in some embodiments, active panel conditioning can be applied to the display when the display is off (e.g., has no image being driven thereto). This active panel conditioning may operate to eliminate (e.g., remove) any retained image on the display from previous content. In some embodiments, a common mode waveform as an active panel conditioning signal may be applied to one or more of the driver TFTs. In some embodiments, the active panel conditioning signal may accelerate hysteresis settling (e.g., reduce an amount of time in which previous image values continue to cause emissions of an LED coupled to the driver TFT). The active panel conditioning signal applied to the display may be selected dynamically based on images previously being displayed and/or as having predetermined characteristics (e.g., amplitudes, frequencies, and/or duty cycles) or as having a set bias value. Use of active panel conditioning may accelerate removal of a previous image from display on the display.

Various refinements of the features noted above may be made in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. The brief summary presented above is intended only to familiarize the reader with certain aspects and contexts of embodiments of the present disclosure without limitation to the claimed subject matter.

BRIEF DESCRIPTION OF THE DRAWINGS

Various aspects of this disclosure may be better understood upon reading the following detailed description and upon reference to the drawings in which.

DETAILED DESCRIPTION OF SPECIFIC EMBODIMENTS

One or more specific embodiments will be described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

As mentioned above, present embodiments relate to electronic displays, particularly to light emitting diode (LED) displays, such as active matrix organic light emitting diode (AMOLED) displays and micro-LED (μLED) displays. In particular, visual artifacts, such as images that remain on the display subsequent to powering off the display, changing the image, ceasing to drive the image to the display, or the like, can be reduced and/or eliminated through the use of active panel conditioning during times when one or more portions of the display is off (e.g., powered down or otherwise has no image being driven thereto). The active panel conditioning can be chosen, for example, based on the image most recently driven to the display (e.g., the image remaining on the display) and/or characteristics of the unique to the display so as to effectively increase hysteresis of driver TFTs of the display.

Figure 1:
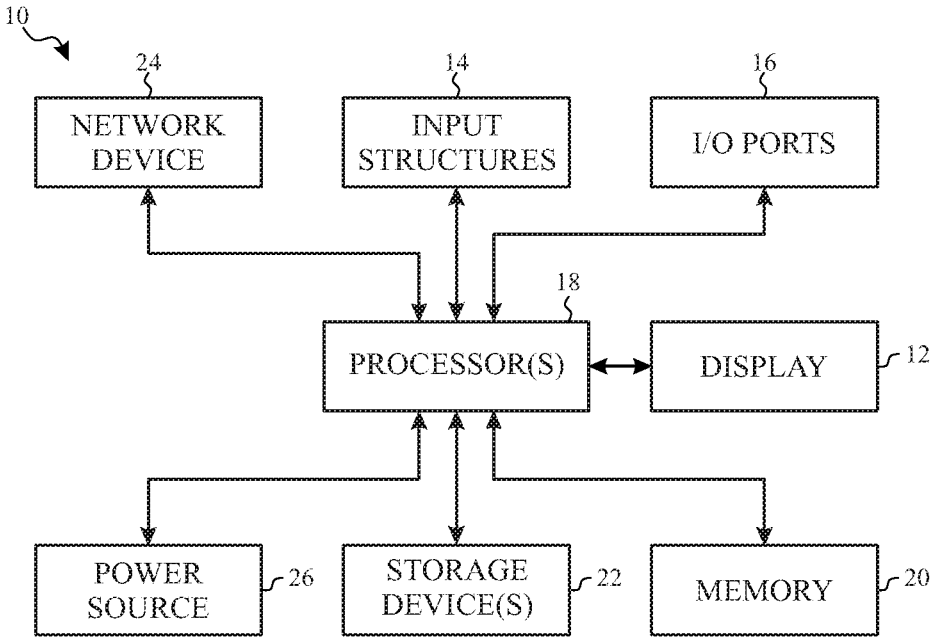
FIG. 1 is a block diagram of a electronic device with an electronic display, in accordance with an embodiment.

To help illustrate, a computing device 10 that may utilize an electronic display 12 to display image frames is described in FIG. 1. As will be described in more detail below, the computing device 10 may be any suitable computing device, such as a handheld computing device, a tablet computing device, a notebook computer, and the like.

Accordingly, as depicted, the computing device 10 includes the electronic display 12, input structures 14, input/output (I/O) ports 16, one or more processor(s) 18, memory 20, a non-volatile storage device 22, a network interface 24, and a power source 26. The various components described in FIG. 1 may include hardware elements (e.g., circuitry), software elements (e.g., a tangible, non-transitory computer-readable medium storing industrious), or a combination of both hardware and software elements. It should be noted that FIG. 1 is merely one example of a particular implementation and is intended to illustrate the types of components that may be present in the computing device 10. Additionally, it should be noted that the various depicted components may be combined into fewer components or separated into additional components. For example, the memory 20 and the non-volatile storage device 22 may be included in a single component.

As depicted, the processor 18 is operably coupled with memory 20 and/or the non-volatile storage device 22. More specifically, the processor 18 may execute instruction stored in memory 20 and/or non-volatile storage device 22 to perform operations in the computing device 10, such as generating and/or transmitting image data to the electronic display 12. As such, the processor 18 may include one or more general purpose microprocessors, one or more application specific processors (ASICs), one or more field programmable logic arrays (FPGAs), or any combination thereof.

Additionally, the memory 20 and the non-volatile storage device 22 may be tangible, non-transitory, computer-readable mediums that store instructions executable by and data to be processed by the processor 18. For example, the memory 20 may include random access memory (RAM) and the non-volatile storage device 22 may include read only memory (ROM), rewritable flash memory, hard drives, optical discs, and the like. By way of example, a computer program product containing the instructions may include an operating system or an application program.

Furthermore, as depicted, the processor 18 is operably coupled with the network interface 24 to communicatively couple the computing device 10 to a network. For example, the network interface 24 may connect the computing device 10 to a personal area network (PAN), such as a Bluetooth network, a local area network (LAN), such as an 802.11x Wi-Fi network, and/or a wide area network (WAN), such as a 4G or LTE cellular network. Furthermore, as depicted, the processor 18 is operably coupled to the power source 26, which may provide power to the various components in the computing device 10, such as the electronic display 12. As such, the power source 26 may include any suitable source of energy, such as a rechargeable lithium polymer (Li-poly) battery and/or an alternating current (AC) power converter.

As depicted, the processor 18 is also operably coupled with I/O ports 16, which may allow the computing device 10 to interface with various other electronic devices, and input structures 14, which may allow a user to interact with the computing device 10. Accordingly, the inputs structures 14 may include buttons, keyboards, mice, trackpads, and the like. Additionally, the electronic display 12 may include touch components that facilitate user inputs by detecting occurrence and/or position of an object touching its screen (e.g., surface of the electronic display 12).

In addition to enabling user inputs, the electronic display 12 presents visual representations by displaying display image frames, such as a graphical user interface (GUI) for an operating system, an application interface, a still image, or video content. As depicted, the electronic display 12 is operably coupled to the processor 18. Accordingly, image frames displayed by the electronic display 12 may be based on image data received from the processor 18. As will be described in more detail below, in some embodiments, the electronic display 12 may display image frames by controlling supply current flowing into one or more display pixels.

Figure 2:
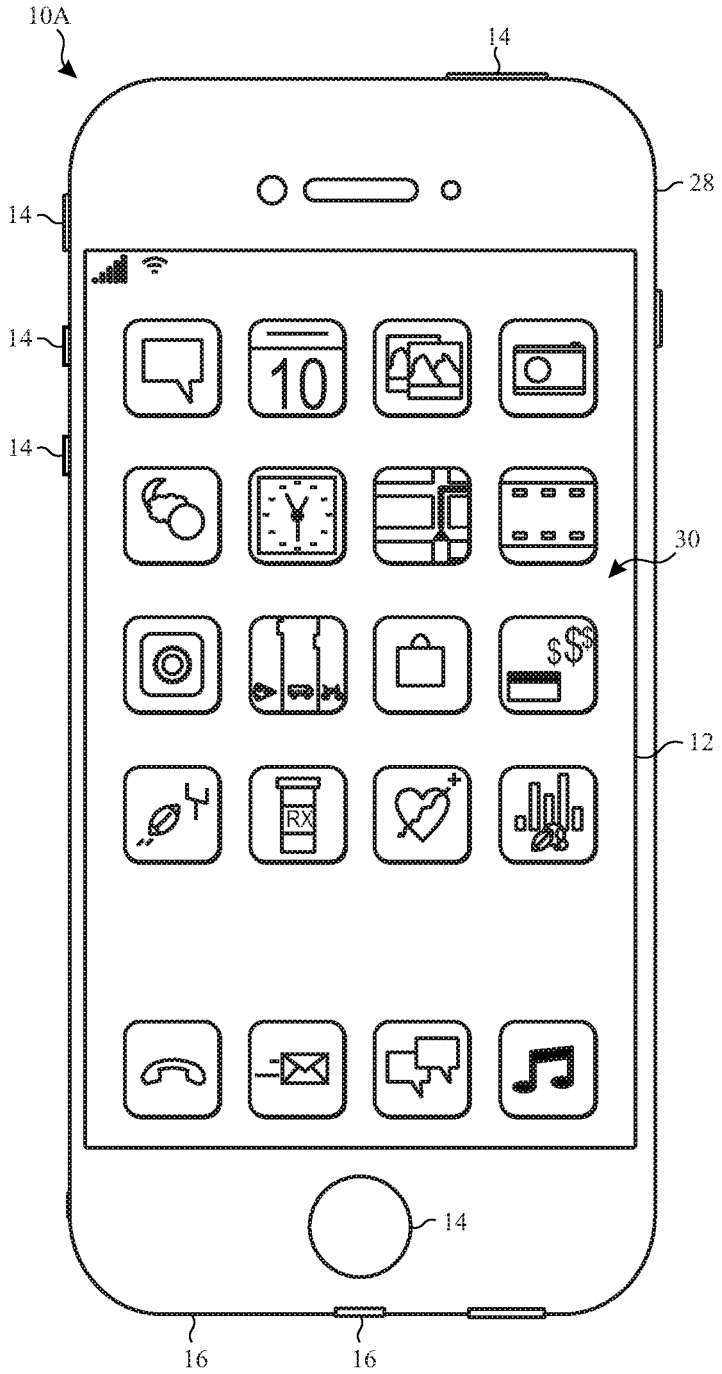
FIG. 2 is an example of the electronic device of FIG. 1, in accordance with an embodiment.

As described above, the computing device 10 may be any suitable electronic device. To help illustrate, one example of a handheld device 10A is described in FIG. 2, which may be a portable phone, a media player, a personal data organizer, a handheld game platform, or any combination of such devices. For example, the handheld device 10A may be a smart phone, such as any iPhone® model available from Apple Inc. As depicted, the handheld device 10A includes an enclosure 28, which may protect interior components from physical damage and to shield them from electromagnetic interference. The enclosure 28 may surround the electronic display 12, which, in the depicted embodiment, displays a graphical user interface (GUI) 30 having an array of icons 31. By way of example, when an icon 31 is selected either by an input structure 14 or a touch component of the electronic display 12, an application program may launch.

Additionally, as depicted, input structure 14 may open through the enclosure 28. As described above, the input structures 14 may allow a user to interact with the handheld device 10A. For example, the input structures 14 may activate or deactivate the handheld device 10A, navigate a user interface to a home screen, navigate a user interface to a user-configurable application screen, activate a voice-recognition feature, provide volume control, and toggle between vibrate and ring modes. Furthermore, as depicted, the I/O ports 16 open through the enclosure 28. In some embodiments, the I/O ports 16 may include, for example, an audio jack to connect to external devices.

Figure 3:
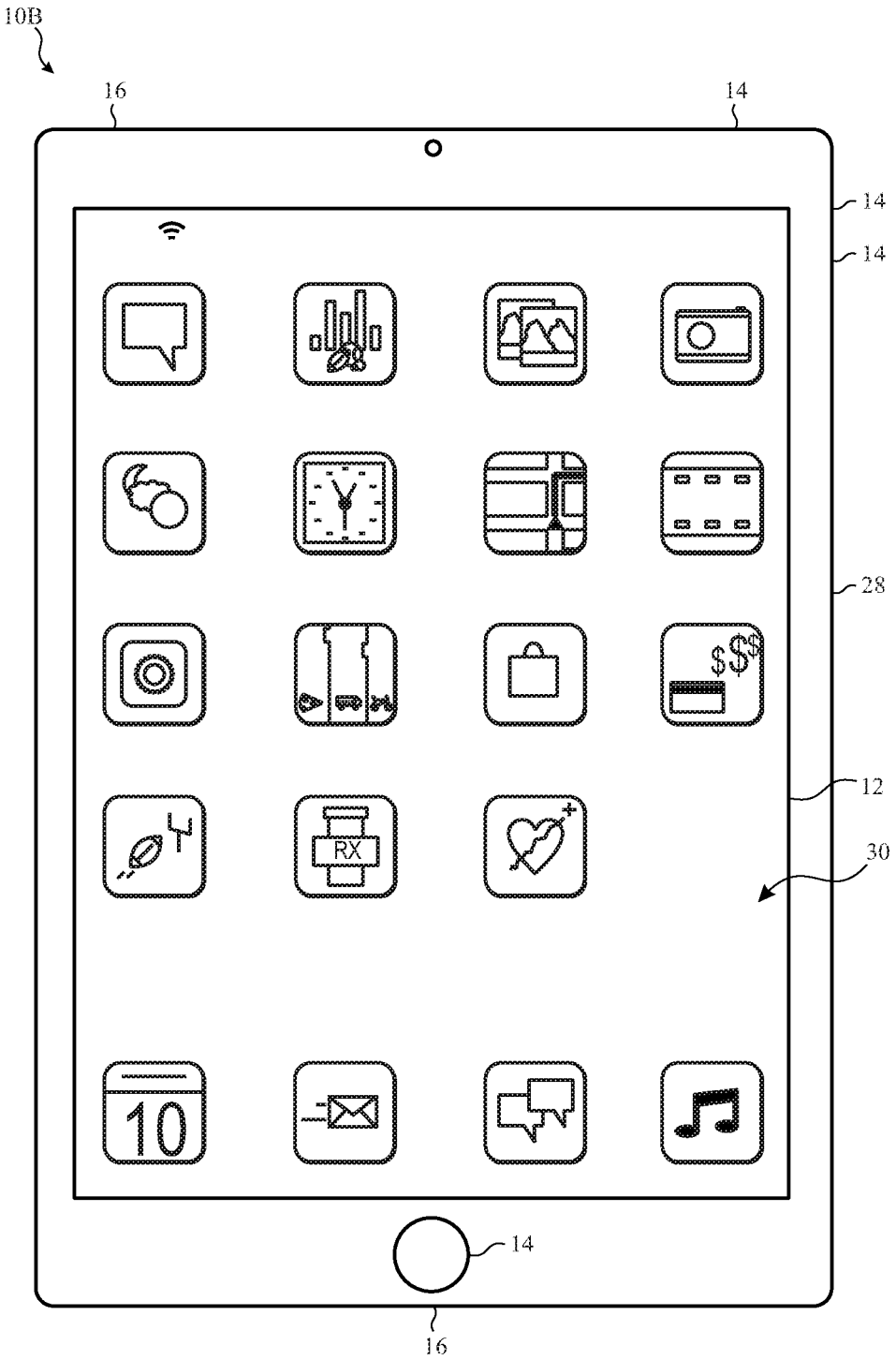
FIG. 3 is an example of the electronic device of FIG. 1, in accordance with an embodiment.
Figure 4:
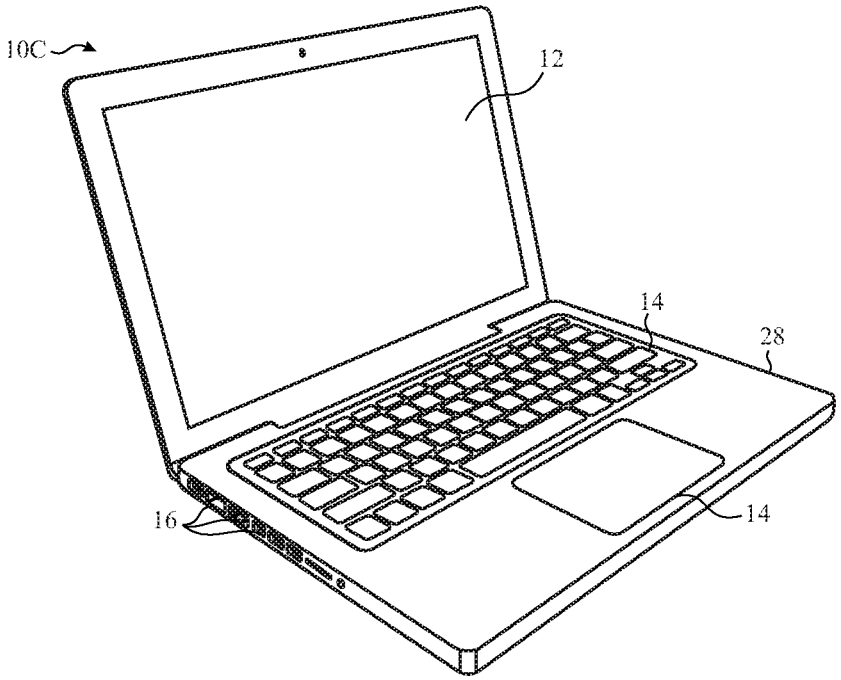
FIG. 4 is an example of the electronic device of FIG. 1, in accordance with an embodiment.
Figure 5:
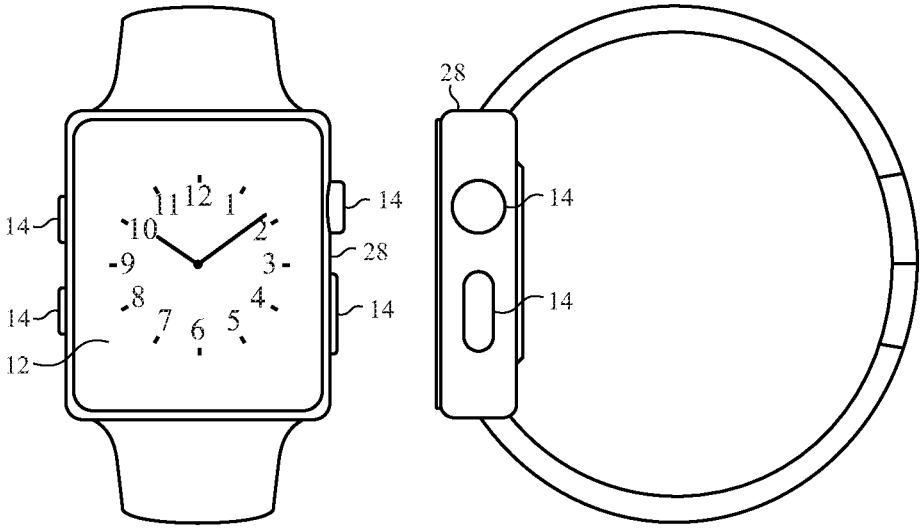
FIG. 5 is an example of the electronic device of FIG. 1, in accordance with an embodiment.

To further illustrate a suitable computing device 10, a tablet device 10B is described in FIG. 3, such as any iPad® model available from Apple Inc. Additionally, in other embodiments, the computing device 10 may take the form of a computer 10C as described in FIG. 4, such as any Macbook® or iMac® model available from Apple Inc. Furthermore, in other embodiments, the computing device 10 may take the form of a watch 10D as described in FIG. 5, such as an Apple Watch® model available from Apple Inc. As depicted, the tablet device 10B, the computer 10C, and the watch 10D may each also include an electronic display 12, input structures 14, I/O ports 16, an enclosure 28, or any combination thereof.

As described above, the computing device 10 may include an electronic display 12 to facilitate presenting visual representations to one or more users. Accordingly, the electronic display 12 may be any one of various suitable types. For example, in some embodiments, the electronic display 12 may be an LED display, such as an AMOLED display, a μLED, a PMOLED display, or the like. Although operation may vary, some operational principles of different types of electronic displays 12 may be similar. For example, electronic displays 12 may generally display image frames by controlling luminance of their display pixels based on received image data.

Figure 6:
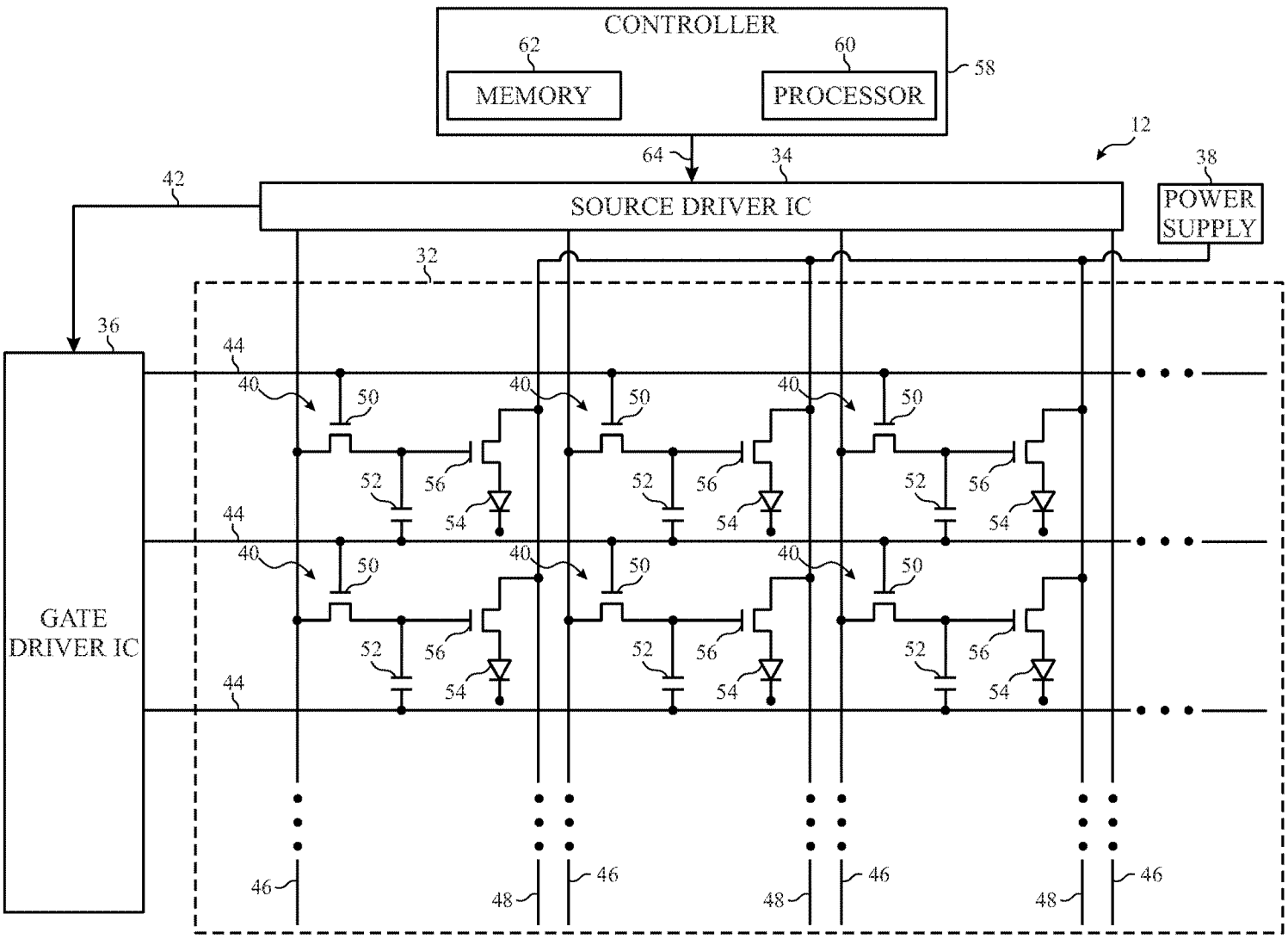
FIG. 6 is block diagram of an light emitting diode (LED) electronic display, in accordance with an embodiment.

To help illustrate, one embodiment of a display 12 is described in FIG. 6. As depicted, the display 12 includes a display panel 32, a source driver 34, a gate driver 36, and a power supply 38. Additionally, the display panel 32 may include multiple display pixels 40 arranged as an array or matrix defining multiple rows and columns. For example, the depicted embodiment includes a six display pixels 40. It should be appreciated that although only six display pixels 40 are depicted, in an actual implementation the display panel 32 may include hundreds or even thousands of display pixels 40.

As described above, display 12 may display image frames by controlling luminance of its display pixels 40 based at least in part on received image data. To facilitate displaying an image frame, a timing controller may determine and transmit timing data 42 to the gate driver 36 based at least in part on the image data. For example, in the depicted embodiment, the timing controller may be included in the source driver 34. Accordingly, in such embodiments, the source driver 34 may receive image data that indicates desired luminance of one or more display pixels 40 for displaying the image frame, analyze the image data to determine the timing data 42 based at least in part on what display pixels 40 the image data corresponds to, and transmit the timing data 42 to the gate driver 36. Based at least in part on the timing data 42, the gate driver 36 may then transmit gate activation signals to activate a row of display pixels 40 via a gate line 44.

When activated, luminance of a display pixel 40 may be adjusted by image data received via data lines 46. In some embodiments, the source driver 34 may generate the image data by receiving the image data and voltage of the image data. The source driver 34 may then supply the image data to the activated display pixels 40. Thus, as depicted, each display pixel 40 may be located at an intersection of a gate line 44 (e.g., scan line) and a data line 46 (e.g., source line). Based on received image data, the display pixel 40 may adjust its luminance using electrical power supplied from the power supply 38 via power supply lines 48.

As depicted, each display pixel 40 includes a circuit switching thin-film transistor (TFT) 50, a storage capacitor 52, an LED 54, and a driver TFT 56 (whereby each of the storage capacitor 52 and the LED 54 may be coupled to a common voltage, Vcom). However, variations of display pixel 40 may be utilized in place of display pixel 40 of FIG. 6. To facilitate adjusting luminance, the driver TFT 56 and the circuit switching TFT 50 may each serve as a switching device that is controllably turned on and off by voltage applied to its respective gate. In the depicted embodiment, the gate of the circuit switching TFT 50 is electrically coupled to a gate line 44. Accordingly, when a gate activation signal received from its gate line 44 is above its threshold voltage, the circuit switching TFT 50 may turn on, thereby activating the display pixel 40 and charging the storage capacitor 52 with image data received at its data line 46.

Additionally, in the depicted embodiment, the gate of the driver TFT 56 is electrically coupled to the storage capacitor 52. As such, voltage of the storage capacitor 52 may control operation of the driver TFT 56. More specifically, in some embodiments, the driver TFT 56 may be operated in an active region to control magnitude of supply current flowing from the power supply line 48 through the LED 54. In other words, as gate voltage (e.g., storage capacitor 52 voltage) increases above its threshold voltage, the driver TFT 56 may increase the amount of its channel available to conduct electrical power, thereby increasing supply current flowing to the LED 54. On the other hand, as the gate voltage decreases while still being above its threshold voltage, the driver TFT 56 may decrease amount of its channel available to conduct electrical power, thereby decreasing supply current flowing to the LED 54. In this manner, the display 12 may control luminance of the display pixel 40. The display 12 may similarly control luminance of other display pixels 40 to display an image frame.

As described above, image data may include a voltage indicating desired luminance of one or more display pixels 40. Accordingly, operation of the one or more display pixels 40 to control luminance should be based at least in part on the image data. In the display 12, a driver TFT 56 may facilitate controlling luminance of a display pixel 40 by controlling magnitude of supply current flowing into its LED 54 (e.g., its OLED). Additionally, the magnitude of supply current flowing into the LED 54 may be controlled based at least in part on voltage supplied by a data line 46, which is used to charge the storage capacitor 52.

FIG. 6 also includes a controller 58, which may be part of the display 12 or externally coupled to the display 12. The source driver 34 may receive image data from an image source, such the controller 58, the processor 18, a graphics processing unit, a display pipeline, or the like. Additionally, the controller 58 may generally control operation of the source driver 34 and/or other portions of the electronic display 12. To facilitate control operation of the source driver 34 and/or other portions of the electronic display 12, the controller 58 may include a controller processor 60 and controller memory 62. More specifically, the controller processor 60 may execute instructions and/or process data stored in the controller memory 62 to control operation in the electronic display 12. Accordingly, in some embodiments, the controller processor 60 may be included in the processor 18 and/or in separate processing circuitry and the memory 62 may be included in memory 20 and/or in a separate tangible non-transitory computer-readable medium. Furthermore, in some embodiments, the controller 58 may be included in the source driver 34 (e.g., as a timing controller) or may be disposed as separate discrete circuitry internal to a common enclosure with the display 12 (or in a separate enclosure from the display 12). Additionally, the controller 58 may be a digital signal processor (DSP), an application-specific integrated circuit (ASIC), or an additional processing unit.

Furthermore, the controller processor 60 may interact with one or more tangible, non-transitory, machine-readable media (e.g., memory 62) that stores instructions executable by the controller to perform the method and actions described herein. By way of example, such machine-readable media can include RAM, ROM, EPROM, EEPROM, or any other medium which can be used to carry or store desired program code in the form of machine-executable instructions or data structures and which can be accessed by the controller processor 60 or by any processor, controller, ASIC, or other processing device of the controller 58.

The controller 58 may receive information related to the operation of the display 12 and may generate an output 64 that may be utilized to control operation of the display pixels 40. The output 64 may be utilized to generate, for example, control signals in the source driver 34 for control of the display pixels 40. Additionally, in some embodiments, the output 64 may be an active panel conditioning signal utilized to reduce hysteresis in driver TFTs 56 of the LEDs 54. Likewise, the memory 62 may be utilized to store the most recent image data transmitted to the display 12 such that, for example, the controller processor 60 may operate to actively select characteristics of the output 64 (e.g., amplitude, frequency, duty cycle values) for the output 64 (e.g., a common mode waveform) based on the most recent image displayed on the LED 54. Additionally or alternatively, the output 64 may be selected for example, by the controller processor 60, based on stored characteristics of the LED 54 that may be unique to each device 10.

Figure 7:
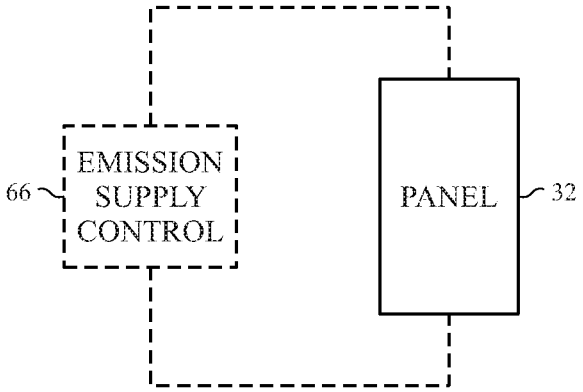
FIG. 7 is a block diagram of light emission control of the LED electronic display of FIG. 6, in accordance with an embodiment.
Figure 8:
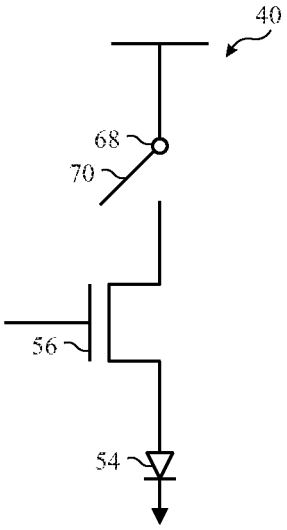
FIG. 8 a second block diagram of light emission control of the LED electronic display of FIG. 6, in accordance with an embodiment.

Active panel conditioning may be undertaken when the display 12 is turned off. In some embodiments, a gate-to-source voltage (Vgs) value may be transmitted to and applied to the driver TFTs 56, for example, as an active panel conditioning signal, which may be part of output 64 or may be output 64. In some embodiments, the active panel conditioning signal (e.g., the Vgs signal) may be a fixed value (e.g., a fixed bias voltage level or value) while in other embodiments, the active panel conditioning signal may be a waveform, which will be discussed in greater detail with respect to FIGS. 9 and 10 below. Fixed voltage schemes (e.g., using a fixed value as the active panel conditioning signal) may have power advantages for the device 10 since, for example, one or more of the portions of the device, such as the processor 18, may shut down and/or may be placed into a sleep mode to save power while, for example the controller 58 and/or the source driver 34 and the gate driver 36 can continue operation. In other embodiments, the controller 58 (in conjunction with or separate from processor 18) may shut down and/or may be placed into a sleep mode to save power while, for example the source driver 34 and the gate driver 36 continue operation. Regardless of the active panel conditioning signal transmitted to the display 12, during the time that the active panel conditioning occurs (e.g., while an active panel conditioning signal is being transmitted to the display 12), it is desirable that emission of light from the display 12 is prevented. FIGS. 7 and 8 illustrate examples of techniques for prevention of emission of light during a time in which active panel conditioning occurs.

FIG. 7 illustrates an example whereby emission by the display panel 32 is prevented, e.g., during active panel conditioning. In some embodiments, this may include, for example, adjustment of the electrical power supplied from the power supply 38 via power supply lines 48. This adjustment may be controlled, for example, by an emission supply control circuit 66 (e.g., a power controller) that dynamically controls the output of power supply 38. In other embodiments, the controller 58 (e.g., via the controller processor 60) or the processor 18 may control the output of power supply 38. The emission control circuit 66 or the controller 58 may cause the power supply 38 to cease transmission of voltage along supply lines 48 during time in which the display panel 32 is off and/or during time in which an active panel conditioning signal is being transmitted to the display panel 32 (although, for example, gate clock generation and transmission may be continued). Through restriction of voltage transmitted along voltage supply lines 48, emission of light by the display 12 can be eliminated. An alternative technique to prevent emission of light from the display panel 32 is illustrated in FIG. 8.

FIG. 8 illustrates inclusion of a switch 68 that may operate to control emission from a pixel 40 of the display panel. As illustrated, the switch 68 may be opened, for example, via a control signal 70. This control signal 70 may be generated and transmitted from, for example, the controller 58 (e.g., via the controller processor 60). For example, the control signal 70 may be part of output 64 when the display 12 is turned off. In some embodiments, the control signal 70 may be distributed in parallel to each of the pixels 40 of the display panel 32 or to a portion of the pixels 40 of the display panel 32. Through opening of the switch 68, voltage may be prevented from being transmitted to the LED 54, thus preventing emission of light from the LED 54. Accordingly, by application of the control signal 70 to any switch 68 for a respective pixel 40 of the display panel 32, emission of light from the LED 54 of that pixel 40 may be controlled.

Figure 9:
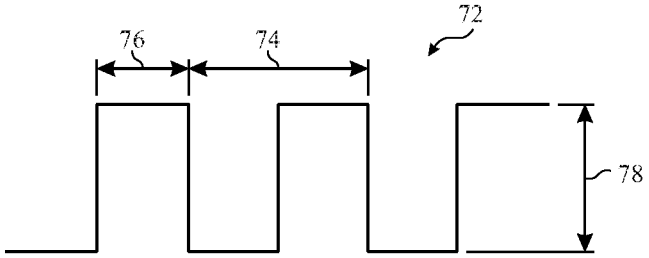
FIG. 9 illustrates a timing diagram inclusive of a control signal provided to the display panel of FIG. 6, in accordance with an embodiment.

As previously noted, elimination of the emission of light from the display 12 may coincide with application of an active panel control signal. FIG. 9 illustrates a first example of an active panel conditioning control signal 72 that may be transmitted to one or more of the pixels of the display 12. As illustrated, active panel conditioning control signal 72 may be a waveform. In some embodiments, this waveform may be dynamically adjustable, for example, by the controller 58 (e.g., via the controller processor 60). For example, the frequency 74 of the active panel conditioning control signal 72, the duty cycle 76 of pulses of the active panel conditioning control signal 72, and/or the amplitude 78 of the active panel conditioning control signal 72 may each be adjusted or selected to be at a determined value.

Additionally, alteration or selection of the characteristics of the active panel conditioning control signal 72 (e.g., adjustment of one or more of the frequency 74, the duty cycle 76, and/or the amplitude 78) may be chosen based on device 10 characteristics (e.g., characteristics of the display panel 32) such that the active panel conditioning control signal 72 may be optimized for a particular device 10. Additionally and/or alternatively, the most recent image displayed on the display 12 may be stored in memory (e.g., memory 62) and the processor 60, for example, may perform alteration or selection of the characteristics of the active panel conditioning control signal 72 (e.g., adjustment of one or more of the frequency 74, the duty cycle 76, and/or the amplitude 78) based on the saved image data such that the active panel conditioning control signal 72 may be optimized for a particular image. However, in some embodiments, a waveform as the active panel conditioning control signal 72 may not be the only type of signal that may be used as part of the active panel conditioning of a display 12.

Figure 10:
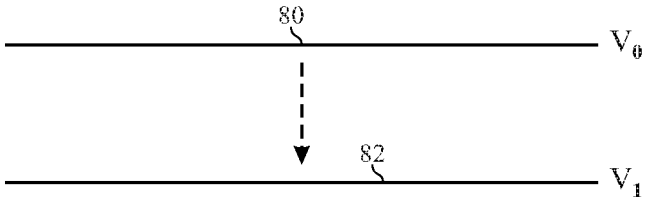
FIG. 10 illustrates a second timing diagram inclusive of a control signal provided to the display panel of FIG. 6, in accordance with an embodiment.

As illustrated in FIG. 10, an active panel conditioning control signal 80 that may be transmitted to one or more of the pixels of the display 12 may have a fixed bias (e.g., voltage level) of $V_0$. Likewise, an active panel conditioning control signal 82 that may be transmitted to one or more of the pixels of the display 12 may have a fixed bias (e.g., voltage level) of $V_1$. In some embodiments, $V_0$ may correspond to a "white" image while $V_1$ may correspond to a "black" image, although, any value between $V_0$ and $V_1$ may be chosen. For example, if $V_0$ corresponds greyscale value of 255 and $V_0$ corresponds to a greyscale value of 0, any greyscale value therebetween (inclusive of 0 and 255) may be chosen as a fixed bias level for the active panel conditioning control signal generated and supplied to the driver TFTs of the display 12.

Alteration or selection of a fixed bias level for an active panel conditioning control signal may be chosen based on device 10 characteristics (e.g., characteristics of the display panel 32) such that the active panel conditioning control signal may be optimized for a particular device 10. Additionally and/or alternatively, the most recent image displayed on the display 12 may be stored in memory (e.g., memory 62) and the processor 60, for example, may perform alteration or selection of a fixed bias level for an active panel conditioning control signal based on the saved image data such that the active panel conditioning control signal may be optimized for a particular image.

Figure 11:
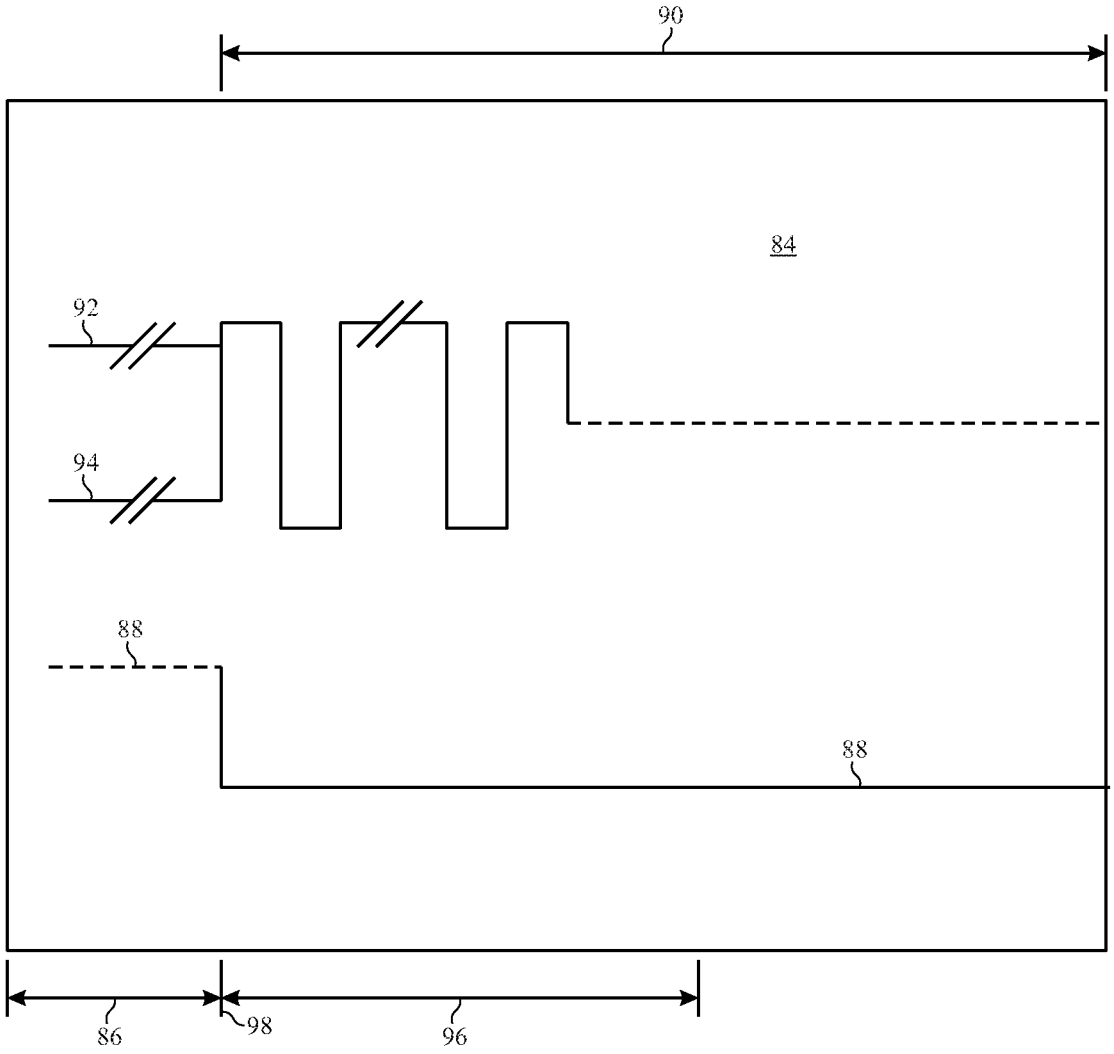
FIG. 11 illustrates a third timing diagram illustrating a control signal provided to the display panel of FIG. 6, in accordance with an embodiment.

FIG. 11 illustrates a timing diagram 84 illustrating active panel conditioning with the active panel conditioning control signal 72. However, it should be noted that active panel conditioning control signal 80 or 82 can be substituted for the active panel conditioning control signal 72 in FIG. 11. During a first period of time 86 the display 12 is on and an emission signal 88 is illustrated as being logically "1" or "high" to indicate that the display 12 is emitting light. During a second period of time 90, the display 12 is off and the emission signal 88 is illustrated as being logically "0" or "low" to indicate that the display 12 no longer emitting light (for example, as discussed in conjunction with FIGS. 7 and 8). Likewise, during the first period of time 86, a first pixel 40 has a gate-to-source voltage (Vgs) value 92, while a second pixel 40 has a Vgs value 94 that each correspond to the operation of the respective pixel 40 during the image generation and display of that image during the first period of time 86. While only two Vgs values 92 and 94 are illustrated, it is understood that each active pixel 40 of the display 12 has a respective Vgs value corresponding to an image being generated during the first period of time 86.

During the second period of time 90, the active panel conditioning control signal 72 may be transmitted to each of the pixels 40 of the display 12 (or to a portion of the pixels 40 of the display 12) for a third period of time 96, which may be a subset of time of the second period of time 90 that begins at time 98 between the first period of time 86 and the second period of time 90 (e.g., where time 98 corresponds to a time at which the display 12 is turned off or otherwise deactivated). Through application of the active panel conditioning control signal 72 to the respective pixels 40, the hysteresis of the driving TFTs 56 associated with the respective pixels 40 may be reduced so that at the completion of the second period of time 90, the Vgs values 92 and 94 will be reduced from their levels illustrated in the first period of time 86 so that the image being displayed during the first period of time 86 will not be visible or will be visually lessened in intensity (e.g., to reduce or eliminate any ghost image, image retention, etc. of the display 12).

Figure 12:
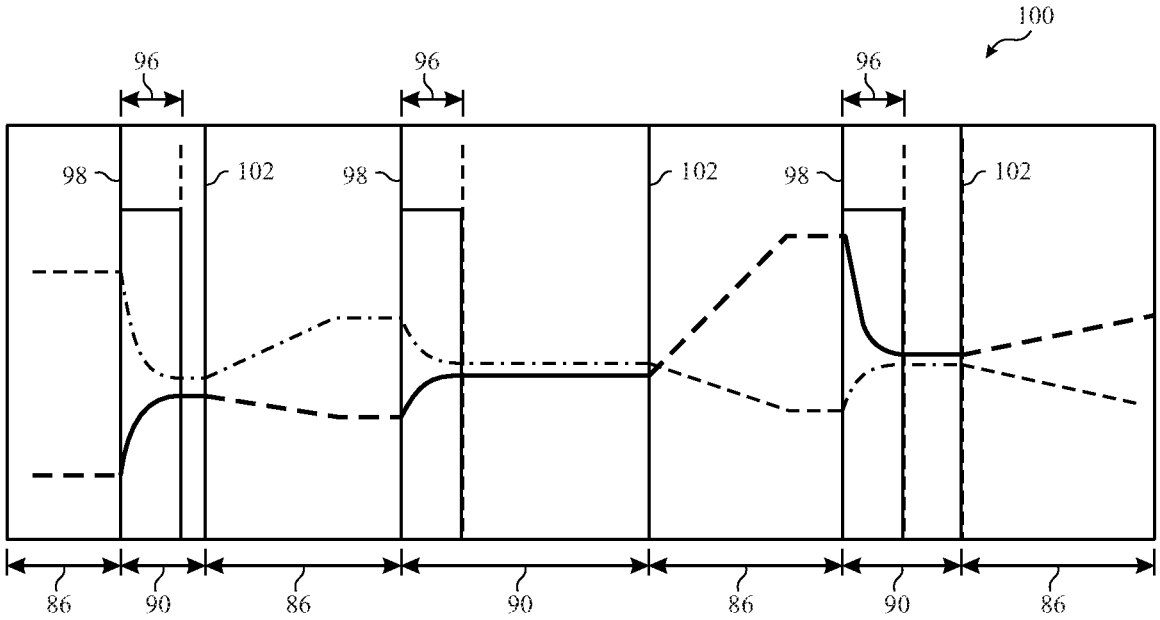
FIG. 12 illustrates a fourth timing diagram inclusive of a control signal provided to the display panel of FIG. 6, in accordance with an embodiment.

Effects from the aforementioned active panel conditioning are illustrated in the timing diagram 100 of FIG. 12. During time 86, the display 12 is on and the display 12 is emitting light. During time 90, the display 12 is off and the display 12 no longer emitting light (for example, as discussed in conjunction with FIGS. 7 and 8). Time 98 corresponds to a time at which the display 12 is turned off or otherwise deactivated and time 102 corresponds to a time at which the display 12 is turned on or otherwise activated to emit light (e.g., generate an image). Likewise, a first pixel 40 has a Vgs value 92, while a second pixel 40 has a Vgs value 94 that each correspond to the operation of the respective pixel 40 during the image generation and display of that image during the periods of time 86. Moreover, while only two Vgs values 92 and 94 are illustrated, it is understood that each active pixel 40 of the display 12 has a respective Vgs value corresponding to an image being generated during a respective period of time 86.

Additionally, during the periods of time 90, an active panel conditioning control signal (e.g., active panel conditioning control signal 72 or active panel conditioning control signal 80) may be transmitted to each of the pixels 40 of the display 12 (or to a portion of the pixels 40 of the display 12) for the periods of time 96, which may be a subset of times 90 that begin at times 98. As illustrated, through application of the active panel conditioning control signal to the respective pixels 40, the hysteresis of the driving TFTs 56 associated with the respective pixels 40 may be reduced so that at the completion of times 90, the Vgs values 92 and 94 are reduced from their levels illustrated in the respective periods of time 86 so that images corresponding to the Vgs values 92 and 94 of a prior period of time 86 are not carried over into a subsequent period of time 86 (e.g., reducing or eliminating any ghost image, image retention, etc. of the display 12 from previous content during subsequent display time periods 86).

Figure 13:
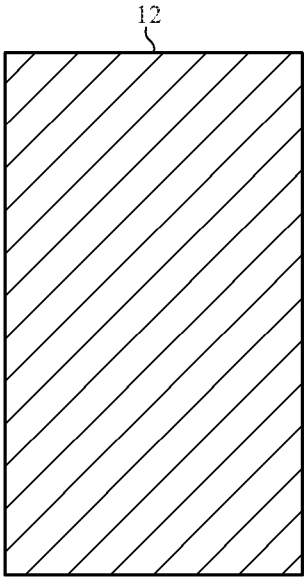
FIG. 13 illustrates the a block diagram of the display of FIG. 6, in accordance with an embodiment.
Figure 14:
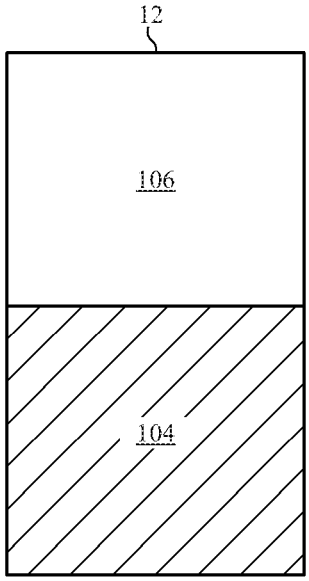
FIG. 14 illustrates a second block diagram of the display of FIG. 6, in accordance with an embodiment.

As illustrated in FIG. 13, active panel conditioning of a display 12 may be applied to an entire display 12 for a period of time 96 (e.g., an active panel conditioning signal may be applied to each driving TFT 56 of a display 12). However, as illustrated in FIG. 14, active panel conditioning of a display 12 may be applied, instead, to a portion 104 of a display 12 while a second portion 106 of the display 12 does not have active panel conditioning applied thereto. For example, in some embodiments, at time 98, only the portion 104 of the display 12 may be turned off and, accordingly, only portion 104 may have an active panel conditioning signal applied to each driving TFT 56 of the portion 104 of the display 12 during a period of time 96. In other embodiments, it may be desirable to refrain from active panel conditioning of portion 106 of a display 12 even when the entire display is turned off at time 98, for example, if portion 106 is likely to have the same or a similar image generated therein when the display 12 is subsequently activated at time 102.

Figure 15:
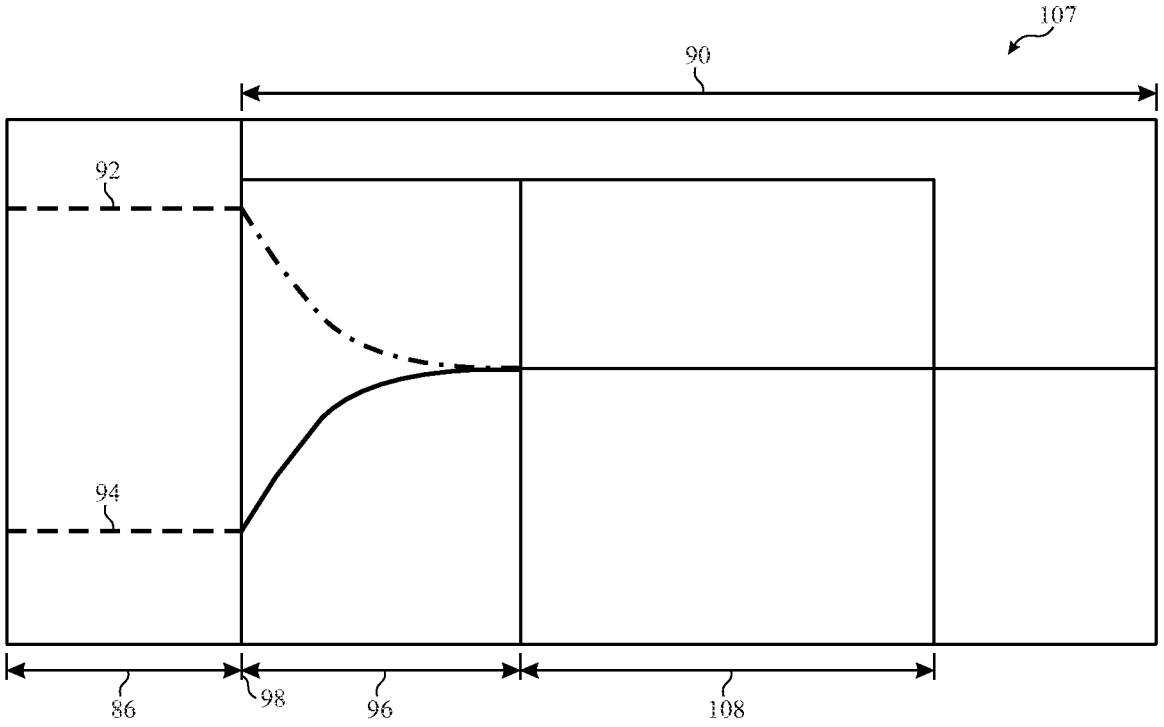
FIG. 15 illustrates a fifth timing diagram inclusive of a control signal provided to the display panel of FIG. 6, in accordance with an embodiment.

As illustrated in the timing diagram 107 of FIG. 15, active panel conditioning may occur in conjunction with additional sensing operations of display 12. For example, during time 86, the display 12 is on and the display 12 is emitting light. During time 90, the display 12 is off and the display 12 no longer emitting light (for example, as discussed in conjunction with FIGS. 7 and 8). Time 98 corresponds to a time at which the display 12 is turned off or otherwise deactivated and additionally illustrated is a Vgs value 92 of a first pixel 40 and a Vgs value 94 of a second pixel 40 that each correspond to the operation of the respective pixel during the image generation and display of that image during a period of time 86. Moreover, while only two Vgs values 92 and 94 are illustrated, it is understood that each active pixel 40 of the display 12 may have a respective Vgs value corresponding to an image being generated during the period of time 86.

Additionally, during the period of time 90, an active panel conditioning control signal (e.g., active panel conditioning control signal 72 or active panel conditioning control signal 80) may be transmitted to each of the pixels 40 of the display 12 for the period of time 96, which may be a subset of time 90 that begins at time 98. Alternatively, as will be discussed in conjunction with FIG. 16, an active panel conditioning control signal (e.g., active panel conditioning control signal 72 or active panel conditioning control signal 80) may be transmitted to one or more portions of the pixels 40 of the display 12 for the period of time 96. As illustrated, subsequent to the period of time 96, a period of time 108 is illustrated as a second subset of the period of time 90. Period of time 108 may correspond to a sensing period of time during which, for example, aging of pixels 40 of the display 12 (or another operational characteristic of the display 12), an attribute affecting the display 12 (e.g., ambient light, ambient temperatures, etc.), and/or an input to the display 12 (e.g., capacitive sensing of a touch by a user, etc.) may be sensed. During the period of time 108, the active panel conditioning control signal may be halted (e.g., transmission of the active panel conditioning control signal may cease as the sensing in time period 108 begins).

Figure 16:
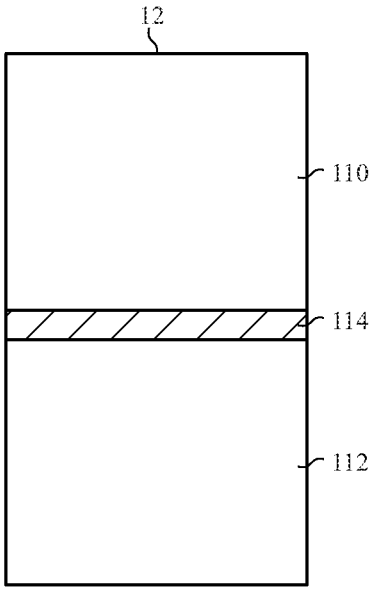
FIG. 16 illustrates a third block diagram of the display of FIG. 6, in accordance with an embodiment.

As illustrated in FIG. 16, an active panel conditioning control signal (e.g., active panel conditioning control signal 72 or active panel conditioning control signal 80) may be transmitted to one or more portions 110 and 112 of the display 12 while another portion 114 of the display 12 does not receive an active panel conditioning control signal. In some embodiments, the portion 114 of the display 12 corresponds to a region in which the aforementioned sensing operation occurs. Accordingly, in some embodiments, active panel conditioning may occur in one or more portions 110 and 112 of the display 12 and not in another portion 114 of the display 12 (e.g., allowing for the portion 114 of the display 12 to operate in a sensing mode in parallel with the active panel conditioning of portions 110 and 112). This may increase the flexibility of the active panel conditioning operation, as it may be performed in a serial manner with a sensing operation (e.g., as illustrated in FIG. 15) or in parallel with a sensing operation (e.g., in conjunction with FIG. 16).

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

What is claimed is:

1. An electronic device, comprising a controller configured to:

provide a first signal to a pixel of a display of the electronic device when the displayed is to be turned off to disconnect a drive transistor coupled to a light emitting diode (LED) of the pixel from a power source; and provide a second signal to the display to alter a gate-to-source voltage of the drive transistor while the display is turned off, wherein the controller is configured to provide the second signal as a waveform signal.

2. The electronic device of claim 1, wherein the controller is configured to provide the second signal to alter a gate-to-source voltage of a second drive transistor coupled to a second LED of second pixel of the display while the display is turned off.

3. The electronic device of claim 1, wherein the controller is configured to prevent emission of light from the display during a period of time in which the second signal is provided to the display.

4. The electronic device of claim 1, wherein the controller is configured to determine the waveform signal provided based on a characteristic of the electronic device.

5. The electronic device of claim 4, wherein the controller is configured to determine the waveform signal by determining at least one of an amplitude of a waveform, a frequency of the waveform, or a duty cycle of the waveform based on the characteristic of the electronic device.

6. The electronic device of claim 1, wherein the controller is configured to determine the waveform signal provided based on stored image data of the display.

7. The electronic device of claim 6, wherein the controller is configured to determine the waveform signal by determining at least one of an amplitude of a waveform, a frequency of the waveform, or a duty cycle of the waveform based on the stored image data of the display.

8. A tangible, non-transitory computer-readable medium configured to store instructions executable by a processor of an electronic device to:

deactivate a first portion of a display of the electronic device;

provide a first control signal to the first portion of the display to prevent emission of light from the first portion of the display during a period of time in which the first portion of the display is deactivated; and while providing the first control signal:

provide a second control signal to the display to modify a gate-to-source voltage of a drive transistor coupled to a light emitting diode (LED) of the first portion of the display; and provide a third control signal to modify an additional gate-to-source voltage of an additional drive transistor coupled to an additional LED of an additional pixel of the display.

9. The non-transitory computer-readable medium of claim 8, comprising instructions to control an output of a power supply coupled to the drive transistor to prevent the emission of light from the LED during the period of time in which the display is deactivated.

10. The non-transitory computer-readable medium of claim 8, comprising instructions to control a switch coupled to the drive transistor to prevent the emission of light from the LED during the period of time in which the display is deactivated.

11. The non-transitory computer-readable medium of claim 8, comprising instructions to sense at least one of an operational characteristic of the display, an attribute affecting the display, and an input to the display.

12. The non-transitory computer-readable medium of claim 8, comprising instructions to transmit image data for display on a second portion of the display of the electronic device during the period of time in which the first portion of the display is deactivated.

13. The non-transitory computer-readable medium of claim 8, comprising instructions to modify a second gate-to-source voltage of a second drive transistor coupled to a second LED of the first portion of the display while the display is deactivated.

14. A method, comprising:

deactivating a first portion of a display of an electronic device after presenting image data via the first portion of the display; and modifying a gate-to-source voltage of a drive transistor coupled to a light emitting diode (LED) of the first portion of the display based at least in part on a control signal generated based on the image data while the display is deactivated.

15. The method of claim 14, comprising sensing at least one of an operational characteristic of the display, an attribute affecting the display, and an input to the display while the display is deactivated.

16. The method of claim 14, comprising sensing at least one of an operational characteristic of the display, an attribute affecting the display, and an input to the display while the gate-to-source voltage of the drive transistor is being modified.

17. The method of claim 14, comprising generating the control signal as a waveform signal.

18. The method of claim 14, comprising generating the control signal as a fixed bias voltage value.

19. The method of claim 18, comprising determining the fixed bias voltage value based on a characteristic of the electronic device.

20. The method of claim 18, comprising determining the fixed bias voltage value based on stored image data of the display.

* * * * *